US005686400A

United States Patent [19]

Urfer et al.

[11] Patent Number: 5,686,400

[45] Date of Patent: Nov. 11, 1997

[54] MANUAL DISHWASHING METHOD USING BETAINE-ANIONIC SURFACTANT MIXTURES

[75] Inventors: Allen D. Urfer, Lansdale; Virginia L. Lazarowitz, Hatfield, both of Pa.

[73] Assignee: Henkel Corporation, Plymouth Meeting, Pa.

[21] Appl. No.: 692,661

[22] Filed: Aug. 6, 1996

Related U.S. Application Data

[62] Division of Ser. No. 286,600, Aug. 5, 1994, which is a continuation of Ser. No. 3,160, Jan. 12, 1993, abandoned.

[51] Int. Cl.[6] ..... C11D 1/94; C11D 1/12; C11D 1/90; C11D 3/22

[52] U.S. Cl. ..... 510/237; 510/235; 510/427; 510/429; 510/470; 510/490; 510/495; 510/498; 510/537

[58] Field of Search ..... 510/237, 235, 510/236, 427, 429, 536, 537, 470, 490, 495, 498

[56] References Cited

U.S. PATENT DOCUMENTS

| | | | |
|---|---|---|---|
| 3,849,548 | 11/1974 | Grand | 424/70.17 |
| 3,950,417 | 4/1976 | Verdicchio et al. | 510/125 |
| 4,137,191 | 1/1979 | Lohr | 510/537 |
| 4,166,048 | 8/1979 | Nishimura et al. | 510/428 |
| 4,246,131 | 1/1981 | Lohr | 510/125 |
| 4,329,334 | 5/1982 | Su et al. | 424/70.19 |
| 4,375,421 | 3/1983 | Rubin et al. | 510/403 |
| 4,554,098 | 11/1985 | Klisch et al. | 510/428 |
| 4,595,526 | 6/1986 | Lai | 510/423 |
| 4,657,999 | 4/1987 | Hoefer et al. | 526/600 |
| 4,668,422 | 5/1987 | Malik et al. | 510/135 |
| 4,772,424 | 9/1988 | Greeb | 510/125 |
| 4,772,425 | 9/1988 | Chirash et al. | 510/236 |
| 4,839,098 | 6/1989 | Wisotzki et al. | 510/235 |
| 4,992,213 | 2/1991 | Mallet et al. | 510/427 |

FOREIGN PATENT DOCUMENTS

| | | |
|---|---|---|
| 0 341 071 | 11/1989 | European Pat. Off. . |
| 0 453 238 | 10/1991 | European Pat. Off. . |

OTHER PUBLICATIONS

G. Proserpio & G. Vianello, "Surfactant–Cosmetic Applications Of A New Glucoside", Rivista Italiana E.P.P.O.S., pp. 567–572, Oct. 1974.

*Primary Examiner*—Ardith Hertzog
*Attorney, Agent, or Firm*—Wayne C. Jaeschke; John E. Drach; Henry E. Millson, Jr.

[57] ABSTRACT

Liquid manual dishwashing detergent compositions which exhibit superior foaming and detergency properties in laboratory tests are comprised of alkyl sulfates, α-olefin sulfonates alkyl betaines, and alkyl polyglycosides.

13 Claims, No Drawings

MANUAL DISHWASHING METHOD USING BETAINE-ANIONIC SURFACTANT MIXTURES

This case is a division of Ser. No. 08/286,600, filed Aug. 5, 1994, which is a file wrapper continuation of Ser. No. 08/003,160, filed Jan. 12, 1993, now abandoned.

BACKGROUND OF THE INVENTION

1. Field of the Invention

This invention relates to liquid manual dishwashing detergent compositions which are comprised of alkyl sulfates, alkyl betaines, and alkyl polyglycosides.

2. Description of the Related Art

Liquid detergents generally consist of aqueous solutions of synthetic anionic and/or nonionic surfactants and conventional additives. They are used in particular for cleaning hard surfaces, for example of glass, ceramic materials, plastics, painted and polished surfaces. One important application for liquid detergents is in the manual washing of eating and cooking utensils, i.e., dishwashing. Dishwashing is generally carried out in highly dilute solutions at slightly elevated temperatures of from about 35° C. to 45° C. The clean power of a detergent is normally judged by the user to be better the longer and the more richly the wash solution foams. Because of the prolonged contact between the hands and the washing solution in manual dishwashing, the compatibility of the detergent with the skin is another particularly important factor. Therefore, skin compatibility must be taken into account when selecting the components of a manual dishwashing detergent.

It is known that betaines are foam boosters in that they enhance the foaming characteristics of various types of detergent compositions. For example, EP 453,238A teaches a mild shampoo composition comprised of: (a) an anionic surfactant such as sodium lauryl sulfate, (b) an amphoteric surfactant such as lauryl dimethyl betaine, and (c) a glycosidic nonionic surfactant such as $C_{10-12}$ alkyl glucoside wherein the weight ratio of a:B:c is 0.9–2.2:0.5–1.0:0.9–2.0. EP 0 341 071 A2 teaches an aqueous composition useful as a manual dishwashing detergent which is comprised of a $C_{8-18}$ alkyl polyglycoside surfactant having an average degree of polymerization of from 1 to 3; an anionic active; a surface active betaine and/or amine oxide; and optionally an ethanolamide wherein the amount of anionic is not greater than 1.5 times (on a molar basis) the level of betaine and/or amine oxide.

SUMMARY OF THE INVENTION

It has been discovered that various surfactant compositions containing betaines are excellent hand dishwashing detergents and perform at least as well as the best commercial hand dishwashing detergents currently on the market in laboratory evaluations. These compositions, which are comprised of betaines and certain anionic and/or nonionic surfactants, exhibit an unexpected ability to retain their detergency and withstand the defoaming action of soils commonly found on soiled dishes. One type of such a composition is comprised of an alkyl sulfate salt and a betaine. Another type of such composition is comprised of an α-olefin sulfonate and a betaine while another is comprised of an alkyl sulfate salt, an α-olefin sulfonate and betaines. Another type of superior hand dishwashing detergent which exhibits good hard water tolerance and is very mild to the skin is comprised of an alkyl sulfate salt, a betaine, and an alkyl polyglycoside or an α-olefin sulfonate, a betaine and an alkyl polyglycoside. A composition particularly effective in retaining its foaming and detergency properties is comprised of about 16% to about 18% by weight of sodium lauryl sulfate, and about 2% to about 4% by weight of cocobetaine, and about 8% to about 10% by weight of Glucopon™600.

DESCRIPTION OF THE PREFERRED EMBODIMENTS

Other than in the operating examples, or where otherwise indicated, all numbers expressing quantities of ingredients or reaction conditions used herein are to be understood as modified in all instances by the term "about."

Applicants have made the surprising discovery that detergent formulations which exhibit superior foaming and detergency properties in a laboratory test designed to evaluate the relative performance of hand dishwashing formulations have the compositions (A)–(E) as follows: (A) compositions comprised of equal parts by weight of a compound of the formula I:

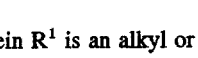

$$R^1—O—SO_3M \quad (I)$$

wherein $R^1$ is an alkyl or alkenyl group having from 10 to 18 carbon atoms and M is an alkali metal cation, alkaline earth metal cation, or ammonium ion and a compound of the formula III:

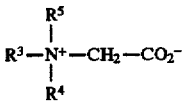

$$R^3—\overset{\overset{R^5}{|}}{\underset{\underset{R^4}{|}}{N^+}}—CH_2—CO_2^- \quad (III)$$

wherein $R^3$ is an alkyl or alkenyl group having from 10 to 18 carbon atoms; $R^4$ and $R^5$ are each independently an alkyl group having from 1 to 4 carbon atoms; a 2-hydroxyethyl group or a 2-hydroxypropyl group; (B) compositions of equal parts by weight of a compound of the formula II:

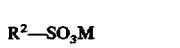

$$R^2—SO_3M \quad (II)$$

wherein $R^2$ is an alkyl or alkenyl group having from 10–18 carbon atoms and M is an alkali metal cation, alkaline earth metal cation, or ammonium ion and a compound of formula III:

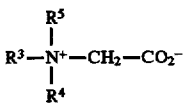

$$R^3—\overset{\overset{R^5}{|}}{\underset{\underset{R^4}{|}}{N^+}}—CH_2—CO_2^- \quad (III)$$

wherein $R^3$ is an alkyl or alkenyl group having from 10 to 18 carbon atoms; $R^4$ and $R^5$ are each independently an alkyl group having from 1 to 4 carbon atoms; a 2-hydroxyethyl group or a 2-hydroxypropyl group; (C) compositions comprised of: (a) from about 16% to about 18% by weight of a compound of the formula I:

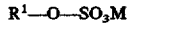

$$R^1—O—SO_3M \quad (I)$$

wherein $R^1$ is an alkyl or alkenyl group having from 10 to 18 carbon atoms and M is an alkali metal cation, alkaline earth metal cation, or ammonium ion; (b) from about 2% to about 4% by weight of a compound of the formula III:

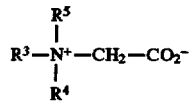

(III)

wherein $R^3$ is an alkyl or alkenyl group having from 10 to 18 carbon atoms; $R^4$ and $R^5$ are each independently an alkyl group having from 1 to 4 carbon atoms; a 2-hydroxyethyl group or a 2-hydroxypropyl group; and (c) from about 8% to about 10% by weight of a compound of the formula IV $$RO(G)_n \quad \text{(IV)}$$

wherein R is a monovalent organic radical containing from about one to about 30 carbon atoms; G represents a moiety derived from a reducing saccharide containing from 5 or 6 atoms; n is a number having an average value from 1 to about 6; (D) compositions comprised of: (a) from about 4% to about 4.5% by weight of a compound of the formula I:

$$R^1—O—SO_3M \quad \text{(I)}$$

wherein $R^1$ is an alkyl group having from 10 to 18 carbon atoms and M is an alkali metal cation, alkaline earth metal cation, or ammonium ion; (b) from about 0.5% to about 1% by weight of a compound of the formula III:

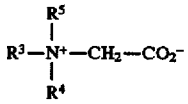

(III)

wherein $R^3$ is an alkyl or alkenyl group having from 10 to 18 carbon atoms; $R^4$ and $R^5$ are each independently an alkyl group having from 1 to 4 carbon atoms; a 2-hydroxyethyl group or a 2-hydroxypropyl group; and (c) from about 2% to about 2.5% by weight of a compound of the formula II:

$$R^2—SO_3M \quad \text{(II)}$$

wherein $R^2$ is an alkyl or alkenyl group having from 10 to carbon atoms and M is an alkali metal cation, alkaline earth metal cation, or ammonium ion; (E) compositions comprised of: (a) from about 4% to about 4.5% by weight of a compound of the formula II:

$$R^2—SO_3M \quad \text{(II)}$$

wherein $R^2$ is an alkyl on alkenyl group having from 10 to 18 carbon atoms and M is an alkali metal cation, alkaline earth metal cation, or ammonium ion; (b) from about 0.5% to about 1% by weight of a compound of the formula III:

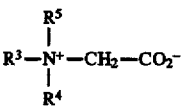

(III)

wherein $R^3$ is an alkyl or alkenyl group having from 10 to 18 carbon atoms; $R^4$ and $R^5$ are each independently an alkyl group having from 1 to 4 carbon atoms; a 2-hydroxyethyl or a 2-hydroxypropyl group; and (c) from about 2% to about 2.5% by weight of a compound of the formula I:

$$R^1—O—SO_3M \quad \text{(I)}$$

wherein $R^1$ is an alkyl group having from 10 to 18 carbon atoms and M is an alkali metal cation or alkaline earth metal cation or ammonium ion.

The alkyl sulfate salts useful in the compositions according to the invention are those of the formula I:

$$R^1—O—SO_3M \quad \text{(I)}$$

wherein $R^1$ is an alkyl group having from 10 to 18 carbon atoms and M is an alkali metal or alkaline earth metal cation. The most preferred alkyl sulfate salt is sodium lauryl sulfate. The α-olefin sulfonate salts useful in the compositions according to the invention are those of the formula II:

$$R^2—SO_3M \quad \text{(II)}$$

wherein $R^2$ is an alkyl group having from 10 to 18 carbon atoms and M is an alkali metal or alkaline earth metal cation. The most preferred α-olefin sulfonate salts are those having a $C_{14-16}$ alkenyl group such as BIO-TERGE AS-40, a trademark product of Stepan Co. The betaines most useful in the compositions according to the invention are those of the formula III:

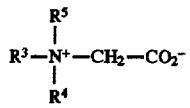

(III)

wherein $R^3$ is an alkyl or alkenyl group having from 10 to 18 carbon atoms; $R^4$ and $R^5$ are each independently an alkyl group having from 1 to 4 carbon atoms; a 2-hydroxyethyl group or a 2-hydroxypropyl group. The most preferred betaine is cocobetaine which is a mixture of compound formula III wherein the majority of $R^3$ groups are $C_{12}$ or lauryl groups and each of $R^4$ and $R^5$ is a methyl. Cocobetaine is sold commercially as VELVETEX®AB-45, a peoduct of Henkel Corporation, Ambler, Pa., 19002. The alkyl polyglycosides useful in the compositions according to the invention are those of the formula IV $$RO(G)_n \quad \text{(IV)}$$

wherein R is a monovalent organic radical containing from about one to about 30 carbon atoms; G represents a moiety derived from a reducing saccharide containing 5 or 6 carbon atoms; n is a number having an average value from 1 to about 6. The preferred alkyl polyglycosides are APG®, Glucopon™, and Plantaren® surfactants, trademark products of Henkel Corporation, Ambler, Pa., 19002.

Examples of APG®, Plantaren®, and/or Glucopon™ surfactants include but are not limited to:

1. Glucopon™ 225—an alkylpolyglycoside in which the alkyl group contains 8 to 10 carbon atoms.
2. APG® 325—an alkyl polyglycoside in which the alkyl group contains 9 to 11 carbon atoms.
3. Glucopon™ 625—an alkyl polyglycoside in which the alkyl groups contains 12 to 16 carbon atoms.
4. APG® 300—an alkyl polyglycoside substantially the same as the 325 product above but having a different average degree of polymerization.
5. Glucopon™ 600—an alkylpolyglycoside substantially the same as the 625 product above but having a different average degree of polymerization.
6. Plantaren® 2000—a $C_{8-16}$ alkyl polyglycoside.
7. Plantaren® 1300—a $C_{12-16}$ alkyl polyglycoside.
8. Plantaren® 1200—a $C_{12-16}$ alkyl polyglycoside.

Other examples include alkyl polyglycoside surfactant compositions which are comprised of mixtures of compounds of formula IV wherein G represents a moiety derived from a reducing saccharide containing 5 or 6 carbon atoms; n is a number from 1.0 to 3; and R is an alkyl radical having from 8 to 20 carbon atoms. The composition is characterized in that it has increased surfactant properties and an HLB in the range of about 10 to about 16 and a non-Flory distribution of glycosides, which is comprised of a mixture of an alkyl monoglycoside and a mixture of alkyl polyglycosides having varying degrees of polymerization of 2 and higher in progressively decreasing amounts, in which the amount by weight of polyglycoside having a degree of polymerization of 2, or mixtures thereof with the polyglycoside having a degree of polymerization of 3, predominate in relation to the amount of monoglycoside, said composition having an average degree of polymerization of about 1.8 to about 3. Such compositions can be prepared by separation of the monoglycoside from the original reaction mixture of alkyl monoglycoside and alkyl polyglycosides after removal of the alcohol. This separation may be carried out by molecular distillation and normally results in the removal of about 70–95% by weight of the alkyl monoglycosides. After removal of the alkyl monoglycosides, the relative distribution of the various components, mono- and poly-glycosides, in the resulting product changes and the concentration in the product of the polyglycosides relative to the monoglycoside increases as well as the concentration of individual polyglycosides to the total, i.e. DP2 and DP3 fractions in relation to the sum of all DP fractions. Such compositions are disclosed in copending application Ser. No. 07/810,588, filed on Dec. 19, 1991, the entire contents of which are incorporated herein by reference.

The detergent compositions according to the invention have been found to exhibit unexpectedly superior performance in a Hand Dishwashing Evaluation test, hereinafter abbreviated HDET. The HDET measures the ability of a hand dishwashing detergent to withstand the defoaming action of synthetic soil by measuring the amount of soil it takes to eliminate the foam from an aqueous solution of the dishwashing detergent. The greater the number produced by the test, the greater the amount of soil it takes to eliminate foam. Thus it will take more soil to eliminate the foam from a superior performing dishwashing detergent than from an inferior performing dishwashing detergent. The HDET protocol is set forth in Example 1.

A synergistic effect on the ability of a surfactant to resist the defoaming effect of a synthetic soil has been found to exist when a trialkyl betaine is mixed with an alkyl sulfate, alkyl sulfonate, and/or an alkyl polyglycoside. Detergent compositions according to the invention are comprised of a surfactant which can be one or more anionic and/or nonionic surfactants and a betaine and may have a surfactant/betaine weight ratio of from about 1/10 to about 10/1 with the preferred ratio being about 1/1. The greatest synergistic effect has been observed for compositions having a surfactant/betaine ratio of about 1/1/. The data in Table 1 illustrate the synergistic effect of an anionic surfactant in combination with cocobetaine. For example, 6.0 grams of soil are required to eliminate the foam from a washing solution containing sodium lauryl sulfate and 6.0 grams of soil are required to eliminate the foam from a washing solution containing cocobetaine. Absent some unexpected effect, one skilled in the art would anticipate that the weight of soil required to eliminate the foam from a washing solution containing a combination of SLS and cocobetaine would be weighted average of the values the individual components. In the example above wherein the weights of SLS and cocobetaine are equal, the average weight of soil are required to eliminate the foam from a washing solution should be 6.0. However, the experimentally observed value is 14.25 which is 137% greater than the predicted value of 6.0 and which indicates that there is a synergism between SLS and cocobetaine. The other combinations of surfactant and cocobetaine listed in Table 1. also exhibit a synergism. The greatest effect is seen with SLS and cocobetaine which also exhibits a greater performance than Dawn™, a leading commercial household manual dishwashing detergent and a trademark product of Proctor and Gamble Company, Cincinnati, Ohio.

Compositions according to the invention which exhibit good hard water tolerance and are also very mild to the skin contain an alkyl polyglycoside in addition to the combination of betaine and anionic surfactant a preferred embodiment of which is a 30% actives aqueous composition comprised of from about 55% to about 60% by weight of SLS (28% active), from about 25% to about 30% by weight Glucopon™600 (50% active), and from about 10% to about 15% by weight cocobetaine (35% active). The following examples are meant to illustrate but no limit the invention.

EXAMPLE 1

Hand Dishing Evaluation Test (HDET)

The test measures the ability of the surfactant to be tested to withstand the defoaming effect of a synthetic soil. The soil is comprised of 37.5% by weight Crisco™ Shortening, 12.5% by weight egg powder, and 50% by weight 150 ppm hard water. The Crisco™ and egg powder were preblended after being weighed into a mixing bowl. The water was then added and the contents of the bowl were heated to 104° F. while mixing at low speed. The mixing was continued until the mixture attained a homogenous, creamy consistency. Soil swatches were prepared by adding about 1.08 grams of the soil, delivered from a syringe, onto 1'×1.5" medium weight terry cloth swatches. To a Tergotometer (U.S. Testing Co.) bucket were placed 345 ml of distilled water and 30 ml of 2000 ppm concentrated hard water. The resulting solution has a calculated hardness as $CaCO_3$ of 150 ppm. The Tergotometer bath was heated to 110° F. and the agitation speed was adjusted to 75 rpm using the hand crank. About 25 ml of a 4% by weight solution of surfactant to be tested was added to the Tergotometer bucket and agitated for 105 seconds and then the agitator was turned off. One soil-treated swatch was added to the Tergotometer bucket over a 15 second period. One swatch was added every 45 seconds of agitation until the surface foam disappeared. Each 45 second period was divided into 10 second intervals and a 10 second interval represents 0.25 swatch. Report is the average off 2 runs as grams of soil required to dissipate the foam. A difference of 0.25 grams is considered significant.

EXAMPLE 2

The data in Table 1 is a listing of the weight in grams of soil required to dissipate the foam in the HDET for various surfactants and combinations of those surfactants with one of the following foam boosters: (a) cocobetaine (Betaine-A), (b) cocoamidopropyl betaine (Betaine-B), or (c) cocoamide DEA (Standamide). For example, the column headed by Betaine-A corresponds to equal weight mixtures a cocobetaine and the surfactants in the column labelled Surfactant.

TABLE 1

| | Wt. (g) of Soil Required to Eliminate Foam in HDET | | | |
|---|---|---|---|---|
| Surfactant[1] | No Betaine | Betaine-A[2] | Betaine-B[3] | Standamide[4] |
| SLS | 6.0 | 14.25 | 10.75 | 8.25 |
| AOS | 8.25 | 12.0 | 10.0 | 8.25 |

TABLE 1-continued

| Surfactant[1] | Wt. (g) of Soil Required to Eliminate Foam in HDET | | | |
|---|---|---|---|---|
| | No Betaine | Betaine-A[2] | Betaine-B[3] | Standamide[4] |
| ABS | 6.5 | 9.0 | 8.25 | — |
| SSS | 5.25 | 9.25 | 8.25 | 9.25 |
| SS | 3.0 | 8.5 | 7.25 | 6.25 |
| APG ® | 5.5 | 9.0 | 8.0 | 7.0 |
| Betaine-A[2] | 6.0 | — | — | — |
| Betaine-B[3] | 6.25 | — | — | — |
| Standamide[4] | 7.25 | — | — | — |
| Dawn ™ | 12.00 | — | — | — |

[1]SLS- sodium lauryl sulfate
AOS- sodium α-olefin sulfonate
ABS- sodium alkyl benzene sulfonate
SSS- sodium lauryl sulfosuccinate
SS- sodium lauryl sarcosinate
APG ® -Glucopon ™ 600
All surfactants were used in equal amounts.
[2]Betaine A is cocobetaine. The mixture had a surfactant/betaine = 1/1.
[3]Betaine-3 is cocoamidopropyl betaine. The mixture had a surfactant/cocoamidopropyl betaine = 1/1.
[4]Standamide is cocoamide DEA. The mixture had a surfactant/stanamide = 1/1.

EXAMPLE 3

Detergent compositions comprised of mixtures of surfactants in a 2/1 by weight ratio were prepared and mixed with a foam booster and tested in the HDET. The final ratios of first surfactant/second surfactant/foam booster were equal to 4.3/2.15/1. The data in Table 2 is a summary of the testing results from the HDET for the various compositions.

TABLE 2

| Surfactant[1] | Wt. (g) of Soil Required to Eliminate Foam in HDET | | | |
|---|---|---|---|---|
| | No Betaine | Betaine-A[2] | Betaine-B[3] | Standamide[4] |
| SLS/AOS | 6.75 | 14.25 | 9.50 | 9.0 |
| AOS/SLS | 7.25 | 11.25 | 9.0 | 8.75 |
| SLS/ABS | 6.0 | 12.5 | 9.75 | 8.25 |
| ABS/SLS | 6.0 | 10.0 | 7.75 | 7.25 |
| AOS/ABS | 7.5 | 12.0 | 9.75 | 9.25 |
| ABS/AOS | 6.5 | 9.75 | 8.0 | 7.75 |
| SLS/APG | 8.0 | 11.25 | 8.5 | 8.75 |

[1]All ratios are 2/1 by weight in each case.
SLS- sodium lauryl sulfate
AOS- sodium α-olefin sulfonate
ABS- sodium alkyl benzene sulfonate
Mixtures of surfactant combinations with a foam booster comprised of 26% by weight surfactant combination and 4% by weight of foam booster.
[2]Betaine A is cocobetaine.
[3]Betaine-3 is cocoamidopropyl betaine.
[4]Standamide is cocoamide DEA.

What is claimed is:

1. A method for washing dishes by hand comprising washing the dishes with a liquid manual dishwashing detergent composition wherein the surfactant component thereof consists of about equal parts by weight of a compound of the formula I:

$$R^1—O—SO_3M \quad (I)$$

wherein $R^1$ is an alkyl group having from 10 to 18 carbon atoms and M is an alkali metal cation, alkaline earth metal cation, or ammonium ion and a compound of the formula III:

$$R^3—\overset{\overset{R^5}{|}}{\underset{\underset{R^4}{|}}{N^+}}—CH_2—CO_2^- \quad (III)$$

wherein $R^3$ is an alkyl or alkenyl group having from 10 to 18 carbon atoms; $R^4$ and $R^5$ are each independently an alkyl group having from 1 to 4 carbon atoms, a 2-hydroxyethyl group or a 2-hydroxypropyl group.

2. The method of claim 1 wherein each of $R^1$ and $R^3$ is a dodecyl group, each of $R^4$ and $R^5$ is a methyl group, and M is $Na^+$.

3. A method for washing dishes by hand comprising washing the dishes with a liquid manual dishwashing detergent composition wherein the surfactant component thereof consists of about equal parts by weight of a compound of the formula II:

$$R^2—SO_3M \quad (II)$$

wherein $R^3$ is an alkyl or alkenyl group having from 10–18 carbon atoms and M is an alkali metal cation, alkaline earth metal cation, or ammonium ion and a compound of the formula III:

$$R^3—\overset{\overset{R^5}{|}}{\underset{\underset{R^4}{|}}{N^+}}—CH_2—CO_2^- \quad (III)$$

wherein $R^3$ is an alkyl or alkenyl group having from 10 to 18 carbon atoms; $R^4$ and $R^5$ are each independently an alkyl group having from 1 to 4 carbon atoms, a 2-hydroxyethyl group or a 2-hydroxypropyl group.

4. The method of claim 3 wherein $R^2$ is a $C_{10-18}$ alkyl group, $R^3$ is a dodecyl group, each of $R^4$ and $R^5$ is methyl group, and M is $Na^+$.

5. A method for washing dishes by hand comprising washing the dishes with a liquid manual dishwashing detergent composition wherein the surfactant component thereof consists of (a) from 16% to 18% by weight of a compound of the formula I:

$$R^1—O—SO_3M \quad (I)$$

wherein $R^1$ is an alkyl group having from 10 to 18 carbon atoms and M is an alkali metal cation, alkaline earth metal cation, or ammonium ion; (b) from 2% to 4% by weight of a compound of the formula III:

$$R^3—\overset{\overset{R^5}{|}}{\underset{\underset{R^4}{|}}{N^+}}—CH_2—CO_2^- \quad (III)$$

wherein $R^3$ is an alkyl or alkenyl group having from 10 to 18 carbon atoms; $R^4$ and $R^5$ are each independently an alkyl group having from 1 to 4 carbon atoms, a 2-hydroxyethyl group or a 2-hydroxypropyl group; and (c) from 8% to 10% by weight of a compound of the formula IV $$RO(G)_n \quad (IV)$$

wherein R is a monovalent organic radical containing from one to about 30 carbon atoms; G represents a moiety derived from a reducing saccharide containing 5 or 6 carbon atoms; and n is a number having an average value from 1 to about 6.

6. The method of claim 5 wherein $R^1$ is a dodecyl group, M is $Na^+$, $R^3$ is a dodecyl group; and $R^4$ and $R^5$ are each independently a methyl group.

7. The method of claim 5 wherein the surfactant component consists of sodium lauryl sulfate, cocobetaine, and an alkyl polyglycoside in which the alkyl groups contain 12 to 16 carbon atoms in which the weight ratio of sodium lauryl sulfate to the alkyl polyglycoside to about 4.3:2.1.

8. A method for washing dishes by hand comprising washing the dishes with a liquid manual dishwashing detergent composition wherein the surfactant component thereof consists of (a) from about 4% to about 4.5% by weight of a compound of the formula I:

$$R^1—O—SO_3M \quad (I)$$

wherein $R^1$ is an alkyl group having from 10 to 18 carbon atoms and M is an alkali metal cation, alkaline earth metal cation, or ammonium ion; (b) from about 0.5% to about 1% by weight of a compound of the formula III:

$$R^3—\overset{\overset{R^5}{|}}{\underset{\underset{R^4}{|}}{N^+}}—CH_2—CO_2^- \quad (III)$$

wherein $R^3$ is an alkyl or alkenyl group having from 10 to 18 carbon atoms; $R^4$ and $R^5$ are each independently an alkyl group having from 1 to 4 carbon atoms, a 2-hydroxyethyl group or a 2-hydroxypropyl group; and (c) from about 2% to about 2.5% by weight of a compound of the formula II:

$$R^2—SO_3M \quad (II)$$

wherein $R^2$ is an alkyl or alkenyl group having from 10–18 carbon atoms and M is an alkali metal cation, alkaline earth metal cation, or ammonium ion.

9. The method of claim 8 wherein $R^1$ is a dodecyl group, M is $Na^+$, $R^3$ is a dodecyl group; and $R^4$ and $R^5$ are each independently a methyl group.

10. The method of claim 8 wherein the surfactant component consists of about 4.3% by weight of sodium lauryl sulfate, about 1% by weight of cocobetaine, and about 2.1% by weight of an α-olefin sulfonate.

11. A method for washing dishes by hand comprising washing the dishes with a liquid manual dishwashing detergent composition wherein the surfactant component thereof consists of: (a) from about 4% to about 4.5% by weight of a compound of the formula II:

$$R^2—SO_3M \quad (II)$$

wherein $R^2$ is an alkyl or alkenyl group having from 10–18 carbon atoms and M is an alkali metal cation, alkaline earth metal cation, or ammonium ion; (b) from about 0.5% to about 1% by weight of a compound of the formula III:

$$R^3—\overset{\overset{R^5}{|}}{\underset{\underset{R^4}{|}}{N^+}}—CH_2—CO_2^- \quad (III)$$

wherein $R^3$ is an alkyl or alkenyl group having from 10 to 18 carbon atoms; $R^4$ and $R^5$ are each independently an alkyl group having from 1 to 4 carbon atoms, a 2-hydroxyethyl group or a 2-hydroxypropyl group; and (c) from about 2% to about 2.5% by weight of a compound of the formula I:

$$R^1—O—SO_3M \quad (I)$$

wherein $R^1$ is an alkyl group having from 10 to 18 carbon atoms and M is an alkali metal cation, alkaline earth metal cation, or ammonium ion.

12. The method of claim 11 wherein $R^1$ is a dodecyl group, M is a $Na^+$, $R^3$ is a dodecyl group; and $R^4$ and $R^5$ are each independently a methyl group, and $R^2$ is a $C_{14-16}$ alkyl group.

13. The method of claim 11 wherein the surfactant component thereof consists of about 4.3% by weight of an α-olefin sulfonate, about 1% by weight of cocobetaine, and about 2.1% by weight of sodium lauryl sulfate.

* * * * *